US008950909B2

(12) United States Patent
Ramirez

(10) Patent No.: US 8,950,909 B2
(45) Date of Patent: Feb. 10, 2015

(54) LIGHT FIXTURE WITH CONCEALED WIREWAY

(76) Inventor: Rafael M. Ramirez, Brooklyn, NY (US)

( * ) Notice: Subject to any disclaimer, the term of this patent is extended or adjusted under 35 U.S.C. 154(b) by 60 days.

(21) Appl. No.: 13/475,046

(22) Filed: May 18, 2012

(65) Prior Publication Data

US 2013/0027923 A1 Jan. 31, 2013

Related U.S. Application Data

(60) Provisional application No. 61/511,595, filed on Jul. 26, 2011.

(51) Int. Cl.

| | |
|---|---|
| ***F21V 21/30*** | (2006.01) |
| ***F21S 8/00*** | (2006.01) |
| *F21V 15/01* | (2006.01) |
| *F21V 21/108* | (2006.01) |

(52) U.S. Cl.

CPC .. *F21S 8/03* (2013.01); *F21V 15/01* (2013.01); *F21V 21/108* (2013.01); *F21S 8/036* (2013.01); *F21V 21/30* (2013.01)

USPC ..... 362/371; 362/457

(58) Field of Classification Search

CPC ..... F21V 21/26; F21V 21/30; F21V 21/34; F21V 21/35; F21V 21/108; F21V 21/10; F21S 8/04; F21S 8/043; F21S 8/066

USPC ..... 362/370, 371, 648, 457, 458

See application file for complete search history.

(56) References Cited

U.S. PATENT DOCUMENTS

| | | | | |
|---|---|---|---|---|
| 2,298,554 | A * | 10/1942 | Elting | 248/342 |
| 4,296,981 | A | 10/1981 | Hildebrandt et al. | |
| 4,414,617 | A * | 11/1983 | Galindo | 362/404 |
| 4,851,973 | A * | 7/1989 | Layne | 362/147 |
| 4,887,196 | A * | 12/1989 | Brown et al. | 362/148 |
| 5,128,847 | A * | 7/1992 | Lin et al. | 362/648 |
| 5,357,414 | A * | 10/1994 | Dane et al. | 362/431 |
| 5,713,662 | A | 2/1998 | Kira | |
| 5,833,358 | A | 11/1998 | Patik | |
| 6,461,016 | B1 | 10/2002 | Jamison et al. | |
| 6,942,363 | B1 * | 9/2005 | LeVasseur | 362/277 |
| 6,951,407 | B2 * | 10/2005 | Herst et al. | 362/147 |
| 7,108,405 | B2 * | 9/2006 | Matts et al. | 362/418 |
| 7,810,957 | B2 * | 10/2010 | Zeng et al. | 362/294 |
| 2003/0021116 | A1 * | 1/2003 | Miller et al. | 362/249 |
| 2008/0101075 | A1 | 5/2008 | Yoshida et al. | |
| 2009/0180301 | A1 | 7/2009 | Mier-Langner et al. | |

* cited by examiner

*Primary Examiner* — Alan Cariaso

(74) *Attorney, Agent, or Firm* — Kloss, Stenger & LoTempio; Vincent G. LoTempio; David Stephenson

(57) ABSTRACT

A bracket device for mounting a light fixture comprising a flat grooved element and a flat cover to conceal and protect the electrical conductors powering the light source inside the lighting fixture is disclosed. When configured to swivel, the bracket device allows for adjustment of the light fixture without introducing significant wear or strain to the electrical conductors passing through the interior portion of the device. This bracket device is thin, compact and of very neat and simple appearance. Because of its thinness and its compact shape this device conceals and its main element can be made to have the same thickness as a prior art mechanical bracket element, which would not normally carry electrical conductors.

12 Claims, 9 Drawing Sheets

LIGHT FIXTURE WITH CONCEALED WIREWAY

CROSS-REFERENCE TO RELATED APPLICATION

This application claims the benefit of priority to U.S. provisional patent application Ser. No. 61/511,595, filed on Jul. 26, 2011.

FIELD OF THE INVENTION

The current invention relates to improvements in lighting fixtures and in particular to lighting fixtures that utilize a light emitting source within an adjustable housing, enclosure or mounting means for the light source.

BACKGROUND OF THE INVENTION

Lighting fixtures that have an adjustable position are very often used as the most effective equipment for certain lighting tasks. Adjustable lighting fixtures can be recessed into ceilings, mounted to electrified track systems, and mounted to permanent or temporary structures or surfaces. By nature of their design, they allow greater operational flexibility, as they can be accurately positioned in order to bring the light to the particular surface, object or task being lit.

Conventionally the prior art utilizes incandescent, fluorescent, high intensity discharge, halogen or LED (light emitting diode) as the light source for such fixtures. These light sources need electric energy in order to operate, as they all work by converting electricity into light.

An existing problem associated with the prior art relates to the way electricity is delivered to the light sources within an adjustable lighting fixture. With the exception of induction lamps, all light sources require that electricity be brought to them by means of electrical conductors, such as wires or cables. The adjustability requirement very often necessitates that the electrical conductors bringing power to the source also be adjustable because the conductors are required to move in some fashion to follow the light source and thereby allow for the position of the light source to be adjusted. Since these electrical conductors travel from the main energy source (mains power) or secondary energy source (transformers, converters, etc) to the light source, they often follow a tortuous path that can run along the inside of moving and static mechanical components, along the outside of the moving or static components or a combination thereof, and very often go around corners and through holes and constrictions within components. Frequent movement and repeated friction along the constrictions often results in premature damage to insulation surrounding the conductor, and/or a short circuit, which can cause shock or death.

Another problem with the prior art is that electrical conductors are exposed to the environment. This makes the electrical insulation of such conductors more likely to fail, due to damage from exposure to ultraviolet rays and exposure to the elements.

A further problem with the prior art is that a longer electrical conductor is required in order to provide enough slack for the conductor to be able to move with the movement of the light source. This longer electrical conductor is often prone to damage from impact with other equipment, tangling during shipping, installation and operation, or snagging.

A further problem with the prior art is the unsightliness of exposed conductors when they are routed along the outside of lighting fixtures. Most adjustable light fixtures are installed and operated in locations were they are within view of the public. As such, simplifying the appearance and providing a cleaner, less cluttered look constitutes a potentially valuable improvement.

Some prior art devices provide flexible connections that combine movable or adjustable mechanical joints with electrical conductors running along the inside of the joints. These joints are almost invariably bulky and oversized to allow the conductors to move smoothly and without constriction in such a way that does not damage the conductors after repeated movement. For the most part, they comprise either an oversized pivoting elbow type of arrangement, or a coiled metal (gooseneck) type of wireway. The oversized pivoting elbow is unsightly because it is typically large. The existing coiled metal wireways do not allow for very stable or repeatable positioning of a light source, and invariably result in the light source's position having to be frequently reset after any servicing or cleaning is performed on the light fixture.

SUMMARY OF THE INVENTION

The invention provides a lighting fixture comprising a bracket having a mounting portion and a groove, and a cover attached to the bracket concealing at least a portion of the groove. The groove may extend from the mounting portion to another area of the bracket. In one embodiment, the groove may extend beyond the cover.

In one embodiment, the bracket may have an outer perimeter, and the cover may be shaped to match at least a portion of the bracket's outer perimeter. In another embodiment, the bracket may have an inner perimeter, and the cover may be shaped to match at least a portion of the bracket's inner perimeter. In one embodiment, the bracket may have both an inner and outer perimeter, and the cover may be shaped to match at least a portion of the bracket's inner and outer perimeter.

In another embodiment, the invention may further comprise a wire residing at least partially in the groove. The wire may be a part of an electrical connection between a power supply and a lamp. The lamp housing may be supported by the bracket and/or connected to a power supply housing. In one embodiment, the lamp housing may be rotatable relative to the bracket.

In one embodiment, the invention may further comprise a power supply. The power supply may be electrically connected to the power supply housing. The bracket and power supply housing may be electrical connected. In one embodiment, the power supply, power supply housing, bracket, and lamp housing are electrically connected. The invention may further comprise a lamp connected to the lamp housing with an electrical conductor.

In another embodiment, the invention may provide a lighting fixture comprising a bracket extending from an electrical track adapter. The bracket has a groove, and a cover attached to the bracket. The cover may conceal at least a portion of the groove. In one embodiment, the lighting fixture may further comprise an electrical wireway over an electrical junction box. A canopy may cover the electrical junction box.

BRIEF DESCRIPTION OF THE DRAWINGS

For a fuller understanding of the nature and objects of the invention, reference should be made to the accompanying drawings and the subsequent description. Briefly, the drawings are.

FURTHER DESCRIPTION OF THE INVENTION

Figure 1:
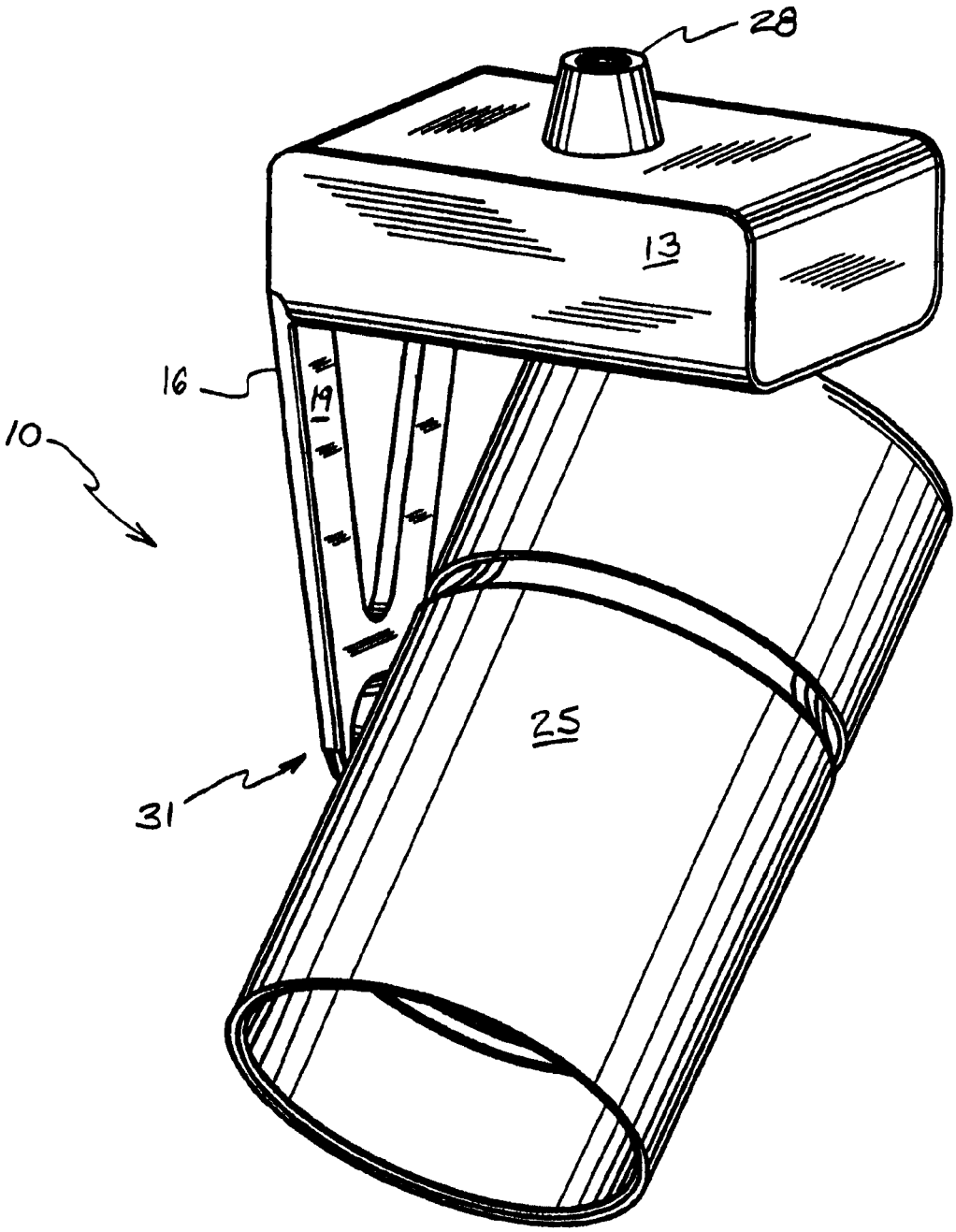
FIG. 1 is a perspective view of a lighting fixture according to the invention.
Figure 2:
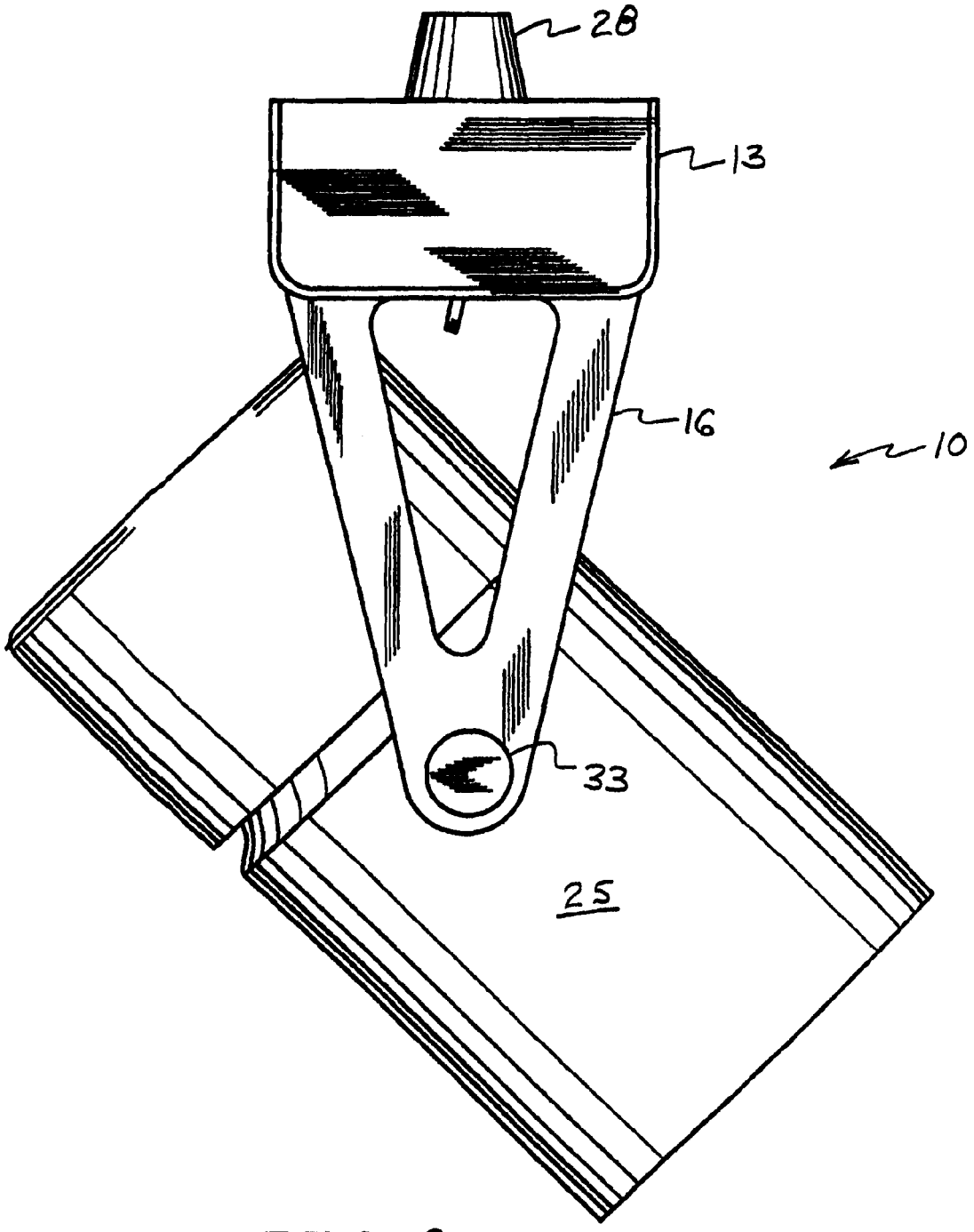
FIG. 2 is a side view of the lighting fixture shown in FIG. 1.
Figure 3:
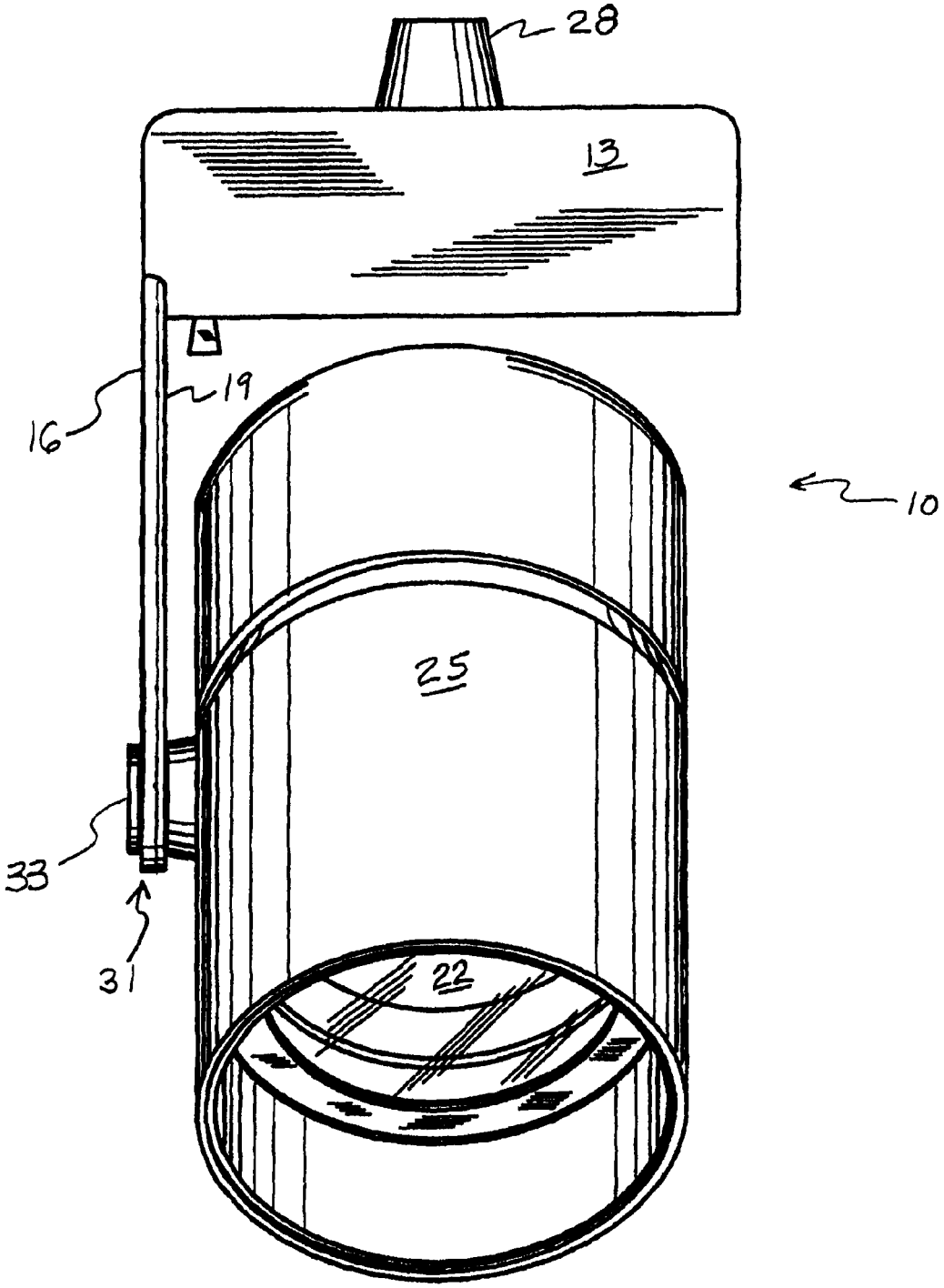
FIG. 3 is a front view of the lighting fixture shown in FIG. 1.

FIGS. 1-3 show a lighting fixture 10 that is in keeping with the invention. In such a fixture 10 there is a power supply housing 13, a bracket 16, a cover 19, a lamp 22, and a lamp housing 25. The power supply housing 13 may include a port 28, which is designed to receive an electrical conductor for supplying electricity to the lamp 22. An interior surface of the port 28 may be threaded for receiving a conduit connector (not shown).

The bracket 16 may be pivotally attached to the lamp housing 25 at a pivot area 31 by inserting a connector 33 through the bracket 16 and into the housing 25. By doing so, the lamp housing 25 may be pivoted to a desired position in order to direct light from the lamp 22 to a desired location.

Figure 4:
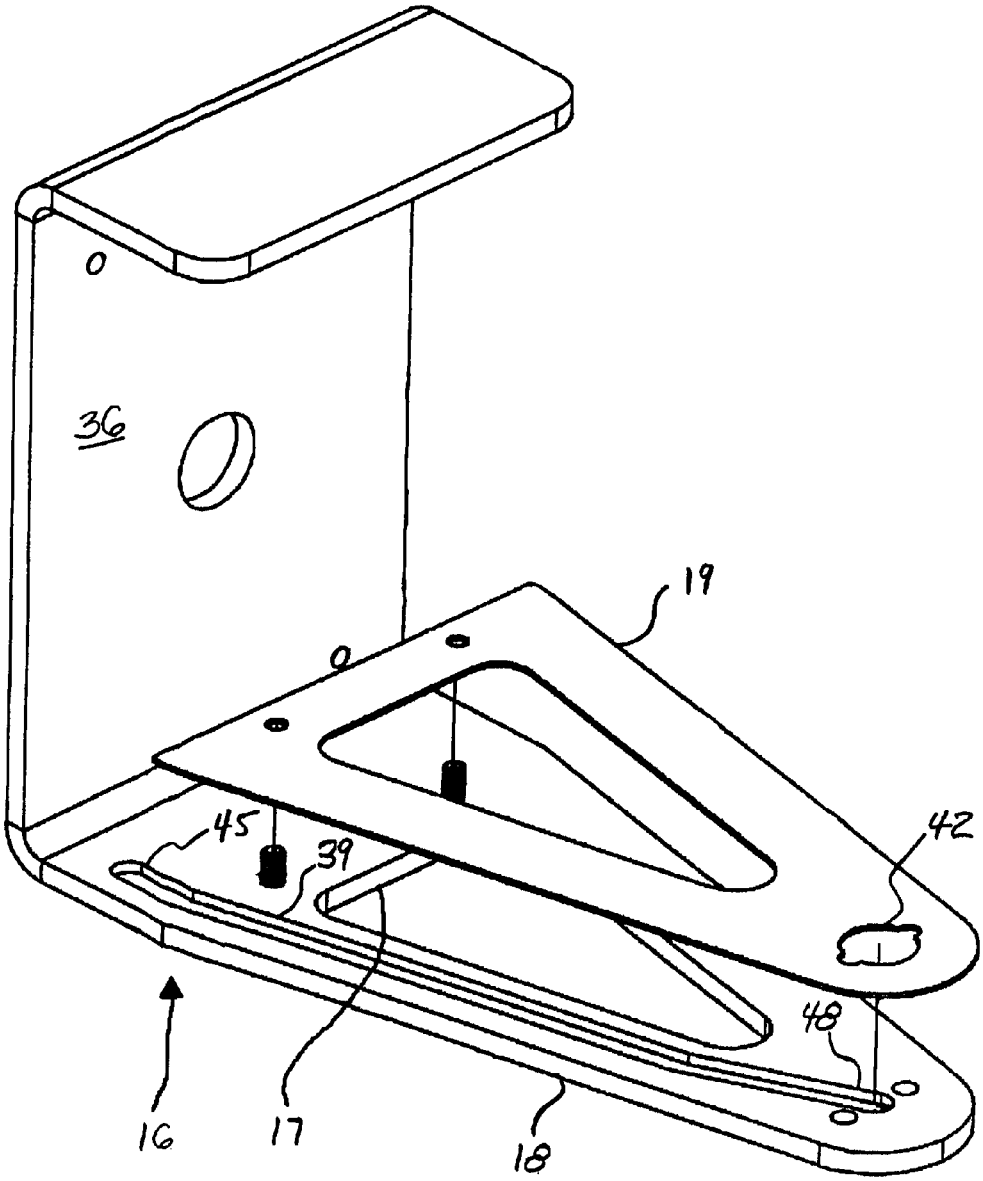
FIG. 4 is a perspective view of a bracket and a cover that are in keeping with the invention.
Figure 5:
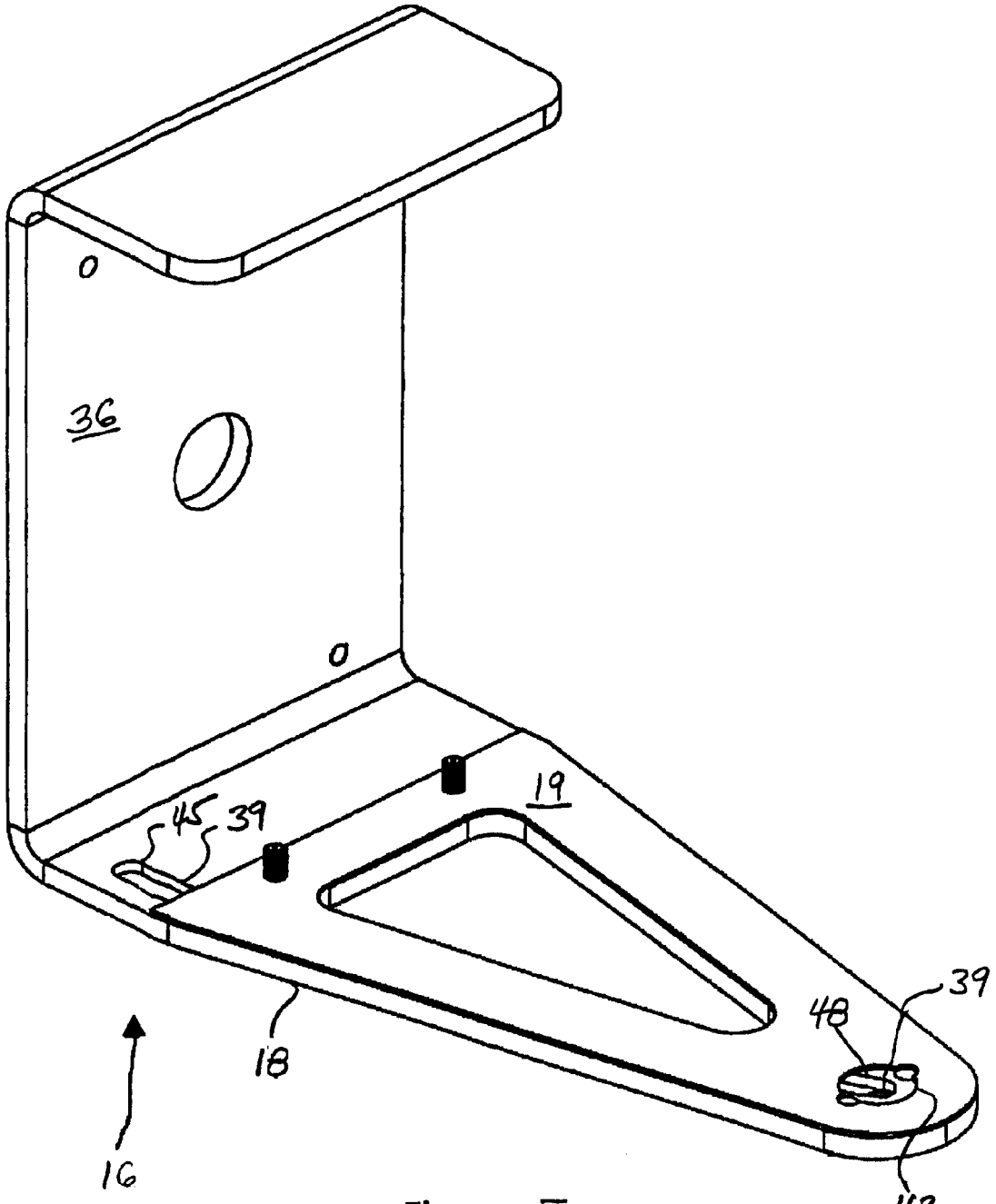
FIG. 5 is a perspective view of the bracket and cover of FIG. 4 in the assembled position.

The bracket 16 and cover 19 are shown in more detail in FIGS. 4 and 5. FIGS. 4 and 5 also show that bracket 16 may include an overarching segment 36 to which the power supply and/or its housing 13 may be attached. In FIGS. 4 and 5 there is shown a groove 39 in the bracket 16 that extends from a lamp side 48 of the bracket 16 to a portion of the bracket 16 that resides near the power supply housing 13. An electrical conductor may extend from the power supply 60 to the lamp 22 via the groove 39. By placing the cover 19 on the bracket 16, the conductor in the groove 39 is substantially concealed from view, thereby improving the appearance of the fixture 10.

The cover 19 may have a shape that is substantially similar to the bracket 16, at least in most areas, so that the cover 19 does not extend beyond the bracket 16. For example, the cover 19 may be shaped to match at least a portion of the bracket's 16 outer perimeter 18, and/or the cover 19 may be shaped to match at least a portion of the bracket's 16 inner perimeter 17 (when the bracket 16 has an inner perimeter 17). In addition, the bracket 16 and cover 19 may have a decorative shape or pattern.

The groove 39 may extend beyond the cover 19 on the power supply side 45 of the groove 39 so that the electrical conductors can easily enter the groove 39. The groove 39 may extend beyond the cover 19 on the lamp side 48 of the groove 39 near the pivot hole 42 so that the electrical conductors can easily enter the lamp housing 25, and ultimately reach the lamp 22. In this manner, the cover 19 may be easily fitted to the bracket 16 while the conductor resides in the groove 39.

Figure 6:
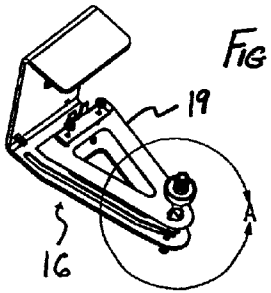
FIG. 6 shows an exploded perspective view of a bracket that is similar to that shown in FIG. 4, and shows the use of a bushing.
Figure 7:
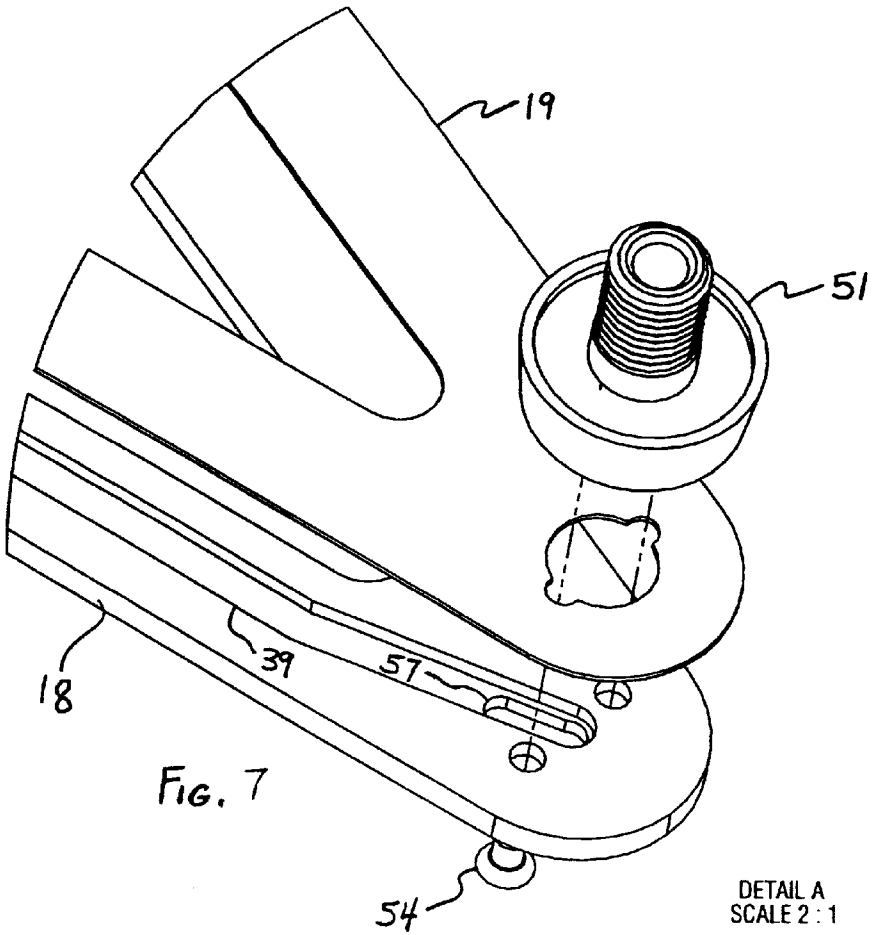
FIG. 7 is an enlargement of area "A" in FIG. 6.

FIGS. 6 and 7 show a bracket and cover similar to that shown in FIG. 4, but also show a bushing 51 that may be used to protect the electrical conductor as it passes from the groove 39 into the housing 25. Two fasteners 54 (one is partially shown in FIG. 7) may be used to engage the bushing 51, and thereby hold the bushing to the cover 19. An enlarged slot 57 is provided adjacent to the groove 39, which facilitates insertion of the electrical conductor during assembly. The fasteners 54 may be covered with a label or decorative cover in order to hide the fasteners 54 and the slot 57.

Figure 8:
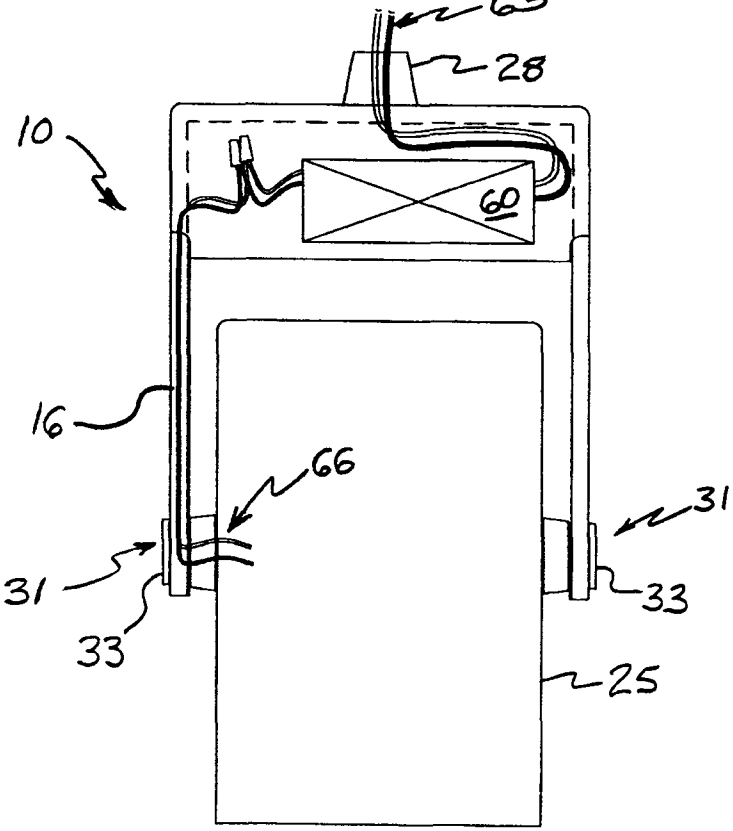
FIG. 8 is a schematic showing an embodiment of the invention.

FIG. 8 is a schematic showing the embodiment of the invention described above. In FIG. 8, there is shown a first set of electrical conductors 63 entering the fixture 10 at the port 28. The first set of electrical conductors 63 deliver electricity at a high voltage to the power supply 60. The power supply 60 reduces the voltage and delivers the low voltage electricity via a second set of electrical conductors 66. The second set of electrical conductors 66 run from the power supply 60, through the groove 39 to the lamp side 48 (not shown in FIG. 8).

Figure 9:
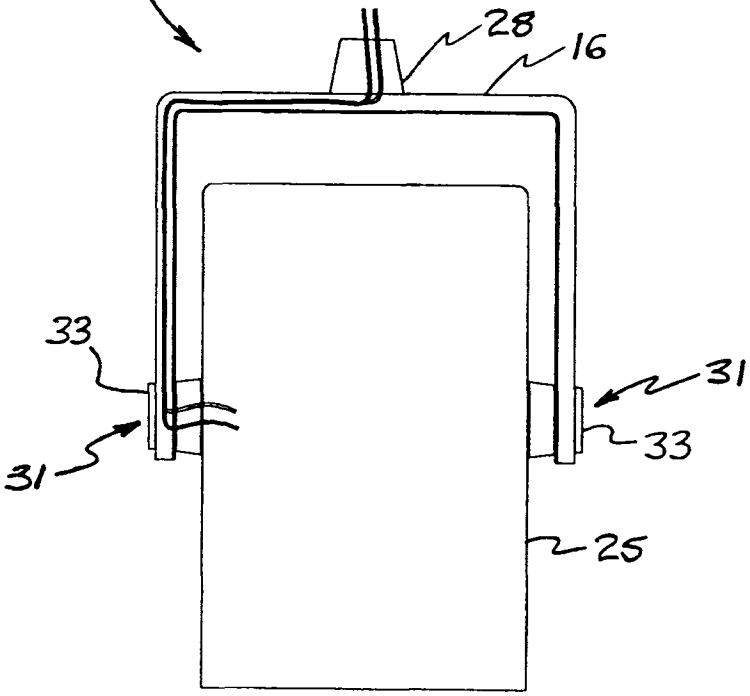
FIG. 9 is a schematic showing a different embodiment of the invention.

In another embodiment, the lamp 22 is powered directly, without the need to modify the voltage provided to the fixture 10. FIG. 9 is a schematic depicting such an embodiment. Such an embodiment of the invention does not require a power supply 60 or housing 13 for the power supply 60. With the exception of the bracket 16 not including a compartment for the power supply 60, the bracket 16, the conductor concealing groove 39, the cosmetic wire cover 19, and other mechanical and cosmetic parts could be substantially the same as the embodiments described above.

Figure 11:
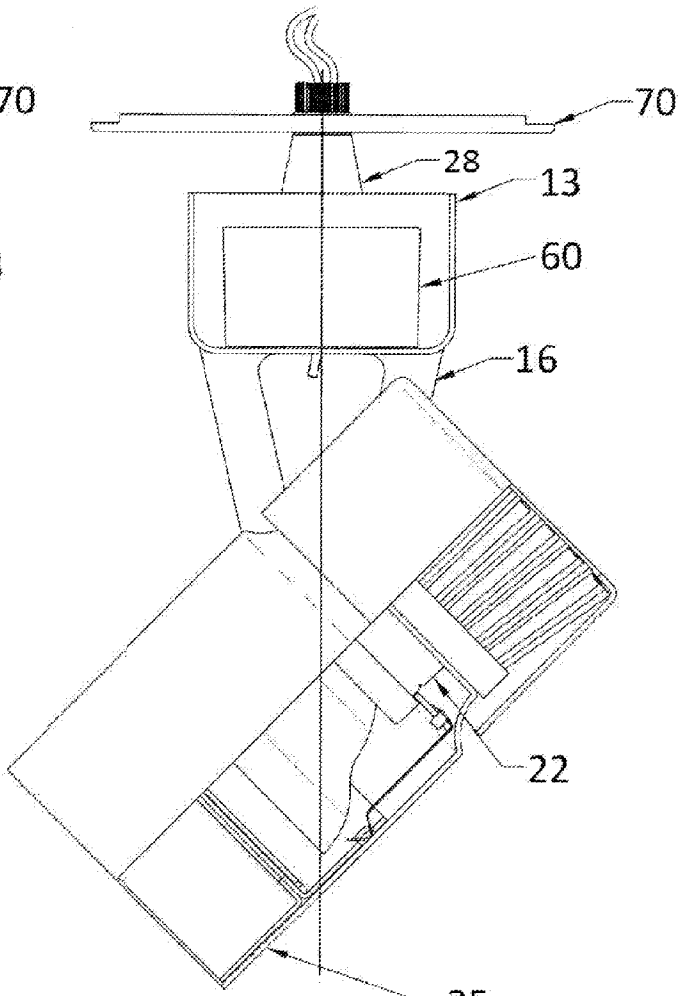
FIG. 11 is a schematic showing a side view of the embodiment of the invention in FIG. 10; and, FIG. 12 is a schematic showing a low-voltage arrangement according to the invention.
Figure 10:
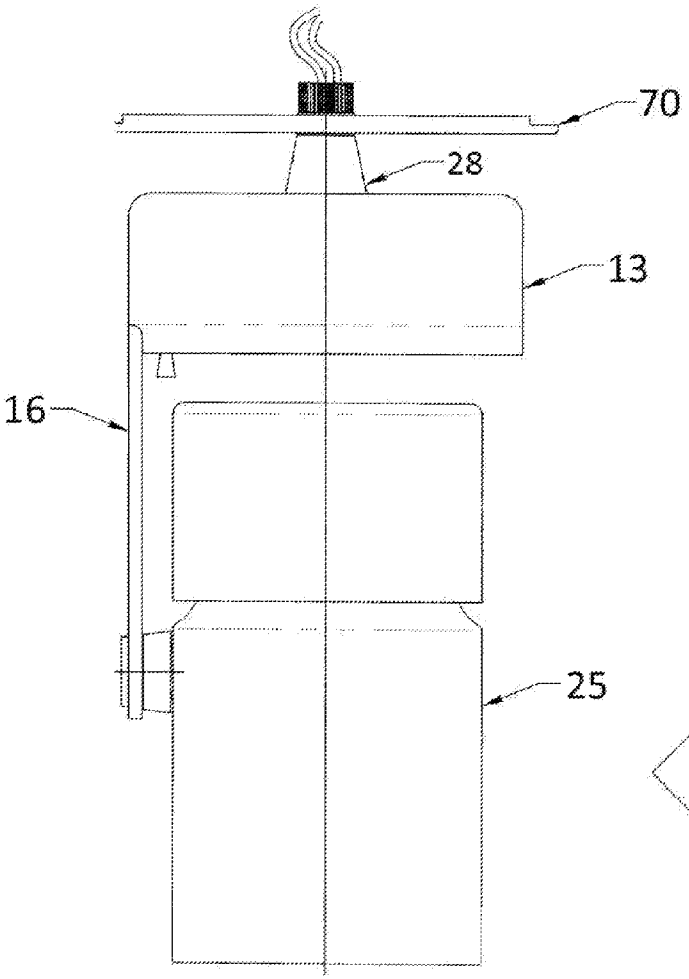
FIG. 10 is a schematic showing a rear view of a different embodiment of the invention.

FIGS. 10 and 11 are schematics showing a rear and side view of another embodiment of the present invention whereby a canopy 70 is attached to the port 28 to allow for attachment to any one of a number of standard electrical junction boxes. Such junction boxes may be mounted flush with the finished surface of a ceiling.

Figure 12:
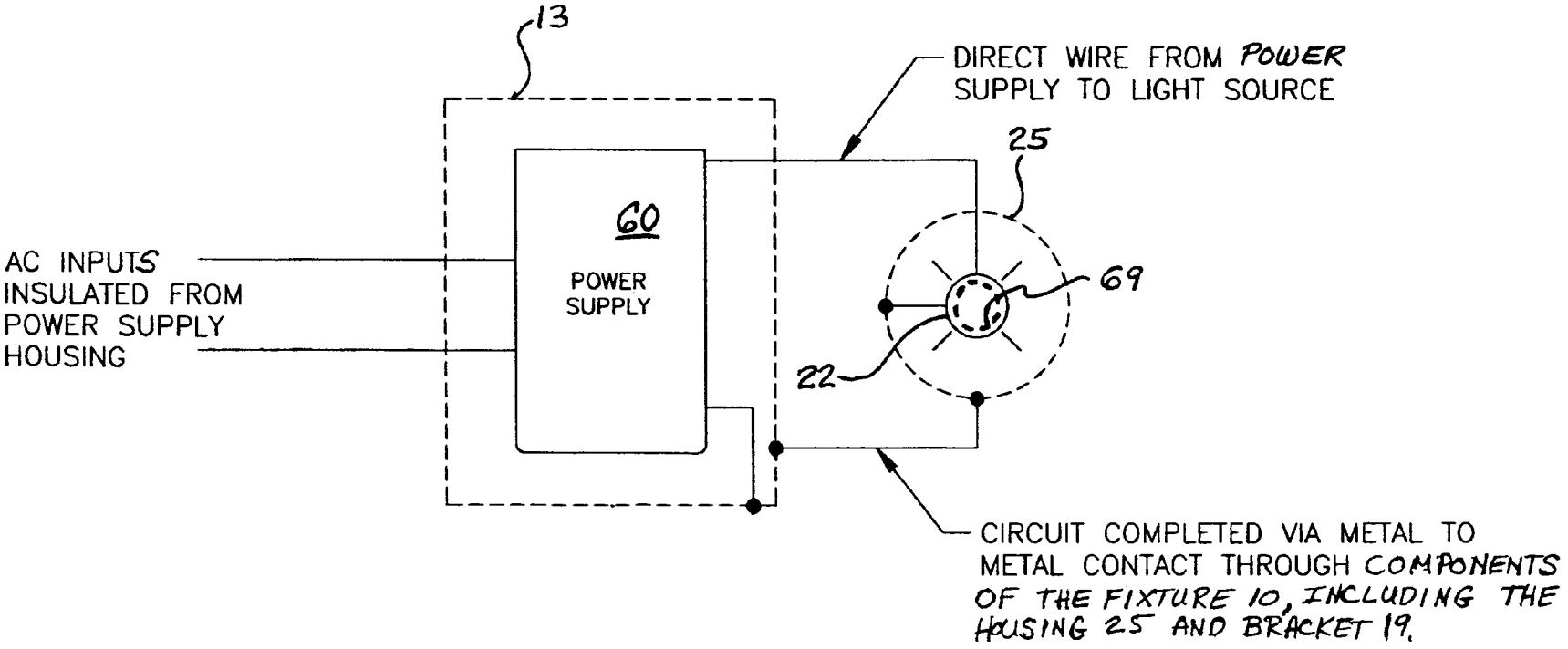

In one embodiment, two wires are placed in the groove 39 in order to complete an electrical circuit between the power supply 60 and the lamp 22. In another embodiment of the invention that may be used with low-voltage/low current lamps 22, one of the wires connecting the power supply 60 to the lamp 22 may be omitted. FIG. 12 is a schematic depicting such an arrangement. The port 28 may be electrically insulated from the housing 13, which is made of an electrically conductive material. Housing 13 could be electrically connected to one of the outputs of a low-voltage power supply 60, via the bracket 19, thereby making the fixture 10 one of the conductors in the electrical circuit between the power supply 60 and the lamp 22. For example, the bracket 19 and a power supply housing 13 may be electrically connected. In another example. the power supply 60, power supply housing 13, bracket 19, and lamp housing 25 may be electrically connected. At the location where the lamp 22 or the lampholder 69 is attached to lamp housing 25, a short wire may be provided in order to electrically connect the lamp housing 25 to one of the electrical terminals on the lamp 22 or lampholder 69.

Although the present invention has been described with respect to one or more particular embodiments, it will be understood that other embodiments of the present invention may be made without departing from the spirit and scope of the present invention. Hence, the present invention is deemed limited only by the appended claims and the reasonable interpretation thereof.

What is claimed is:

1. A lighting fixture, comprising: a bracket having a mounting portion, the bracket having a groove extending from the mounting portion; a cover attached to the bracket and concealing at least a majority of the groove; a lamp housing supported by the bracket; and a wire residing in the groove, the wire being part of an electrical connection between a power supply and a lamp; wherein the groove extends beyond the cover; wherein the lamp housing has two ends; wherein one end is a light emitting end; wherein said housing is elongate and has an opening at the light emitting end through which light is emitted; wherein said bracket attaches to a side of said lamp housing at an attachment point; wherein said attachment point is located centrally between said two ends; wherein said wire enters said lamp housing at said attachment point; and wherein said lamp housing is rotatable relative to the bracket.

2. The fixture of claim 1, wherein the bracket has an outer perimeter, and the cover is shaped to match at least a portion of the bracket's outer perimeter.

3. The fixture of claim 1, wherein the bracket has an inner perimeter, and the cover is shaped to match at least a portion of the bracket's inner perimeter.

4. The fixture of claim 1, wherein the bracket is connected to a power supply housing.

5. The fixture of claim 1 further comprising a power supply, wherein the power supply is electrically connected to a power supply housing.

6. The fixture of claim 5, wherein the bracket and power supply housing are electrically connected.

7. The fighting fixture of claim 5, wherein the power supply, power supply housing, bracket, and lamp homing are electrically connected.

8. The lighting fixture of claim 7, further comprising a lamp, wherein an electrical conductor connects the lamp to the lamp housing.

9. A lighting fixture, comprising: a lamp housing: a bracket extending to and supporting the lamp housing, the bracket having a groove, a wire residing in the groove, the wire being part of an electrical connection between a power supply and a lamp; a cover attached to the bracket and concealing at least a portion of the groove; wherein the groove extends beyond the cover; wherein the lamp housing has two ends; wherein one end is a light emitting end; wherein said housing is elongate and has an opening at the light emitting end through which light is emitted; wherein said bracket attaches to a side of said lamp housing at an attachment point; wherein said attachment point is located centrally between said two ends; wherein said wire enters said lamp housing at said attachment point; wherein said lamp housing is rotatable relative to the bracket.

10. The fixture of claim 9, further comprising a port receiving an electrical conductor.

11. The fixture of claim 9, further comprising a canopy for covering an electrical junction box.

12. The fixture of claim 9, wherein the lamp housing is supported by the bracket.

* * * * *